US008152274B2

(12) United States Patent
Kim et al.

(10) Patent No.: US 8,152,274 B2
(45) Date of Patent: Apr. 10, 2012

(54) IMAGE FORMING APPARATUS

(75) Inventors: Young Choon Kim, Seoul (KR); Karp Sik Youn, Hwaseong-si (KR); Dong Woo Ha, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 498 days.

(21) Appl. No.: 12/274,555

(22) Filed: Nov. 20, 2008

(65) Prior Publication Data

US 2009/0141084 A1 Jun. 4, 2009

(30) Foreign Application Priority Data

Nov. 30, 2007 (KR) ..... 10-2007-0123550
Oct. 2, 2008 (KR) ..... 10-2008-0097023

(51) Int. Cl.
*B41J 2/155* (2006.01)
*B41J 2/14* (2006.01)

(52) U.S. Cl. ..... 347/42; 347/49; 347/50

(58) Field of Classification Search ..... 347/37, 347/42, 49, 50, 86
See application file for complete search history.

(56) References Cited

U.S. PATENT DOCUMENTS

2003/0081055 A1* 5/2003 Wotton et al. ..... 347/33
2005/0146571 A1* 7/2005 Hilton et al. ..... 347/85
2005/0157153 A1* 7/2005 Silverbrook et al. ..... 347/108
2006/0139419 A1* 6/2006 Shigemura ..... 347/85
2007/0097157 A1 5/2007 Na

FOREIGN PATENT DOCUMENTS

| | | |
|---|---|---|
| CN | 1958298 | 5/2007 |
| EP | 0666174 | 8/1995 |
| KR | 20080030119 | 4/2008 |

OTHER PUBLICATIONS

Chinese Office Action issued Apr. 22, 2010 in CN Application No. 200810190825.9.

* cited by examiner

*Primary Examiner* — Geoffrey Mruk
(74) *Attorney, Agent, or Firm* — Stanzione & Kim, LLP

(57) ABSTRACT

An image forming apparatus that provides an easy installation and separation of a print head thereto and therefrom. The image forming apparatus can include a body, a print head including a nozzle part having a length at least a width as wide as a printable printing medium, a head mount provided at the body to mount the print head, at least one first connector provided at the head mount, and at least one second connector provided at the print head to correspond to the at least one first connector. The first connector and second connector are connected with each other as the print head is mounted to the head mount.

27 Claims, 17 Drawing Sheets

IMAGE FORMING APPARATUS

CROSS-REFERENCE TO RELATED APPLICATIONS

This application claims the benefit of Korean Patent Application No. 2007-0123550, filed on Nov. 30, 2007 and Korean Patent Application No. 2008-0097023, filed on Oct. 2, 2008 in the Korean Intellectual Property Office, the disclosures of which are incorporated herein by reference in their entirety.

BACKGROUND OF THE INVENTION

1. Field of the Invention

The present general inventive concept relates to an image forming apparatus, and, more particularly, to an array type image forming apparatus wherein a nozzle part has a length corresponding to a width of a printing medium.

2. Description of the Related Art

An image forming apparatus is an apparatus to develop a black-and-white image or a color image on a printing medium, such as paper, according to a print signal. Examples of the image forming apparatus include laser printers, inkjet printers, copiers, facsimiles, and devices combining functions thereof.

Of various image forming apparatuses, an inkjet type image forming apparatus is designed to form an image by ejecting liquid-phase ink to a printing medium surface according to a print signal. Such an inkjet type image forming apparatus includes a print head to eject ink according to a print signal. As the print head ejects ink droplets according to a print signal, an image such as a letter, figure, etc., is printed on a printing medium.

The inkjet type image forming apparatus is classified into a shuttle type image forming apparatus and an array type image forming apparatus. In the shuttle type image forming apparatus, a print head ejects ink while reciprocating in a direction orthogonal to a delivery direction of the printing medium, namely, in a width direction of the printing medium. In the array type image forming apparatus, a length of a print head corresponds to a width of a printing medium to enable line printing.

The print head of the array type image forming apparatus is provided with a plurality of head chips arranged in a width direction of a printing medium to enable line printing, a regulator to apply a negative pressure to ink being delivered to the head chips, and an ink tank in which the ink to be ejected from the head chips is stored, and the like.

The above-described print head of the array type image forming apparatus becomes superannuated during use and therefore, is detachably mounted in a body to enable exchange thereof. However, exchange of the print head requires troublesome fitting and separating operations because power and signal cables extending from the print head must be separated from the print head prior to separating the print head, and then, the power cable and signal cable must be reconnected to a new print head after the new print head is fitted into the body.

SUMMARY OF THE INVENTION

The present general inventive concept provides an image forming apparatus including a print head which is easy to exchange.

Additional features and utilities of the present general inventive concept will be set forth in part in the description which follows and, in part, will be obvious from the description, or may be learned by practice of the general inventive concept.

Embodiments of the present general inventive concept provides an image forming apparatus including: a body; a print head including a nozzle part having a length at least greater than a width of a printable printing medium; a head mount provided at the body for mounting of the print head; at least one first connector provided at the head mount; and at least one second connector provided at the print head to correspond to the at least one first connector, wherein the first connector and second connector are connected with each other as the print head is mounted to the head mount.

The first connector may include at least one of a first power connector to supply power to the print head, a first signal connector to transmit signals to the print head, a first supply connector connected with an ink supply tube for supply of ink, and a first discharge connector connected with an ink discharge tube for discharge of ink of the print head.

The second connector may include at least one of a second power connector connected with the first power connector to receive power, a second signal connector connected with the first signal connector to receive signals transmitted thereto, a second supply connector connected with the first supply connector to supply ink into the nozzle part, and a second discharge connector connected with the first discharge connector to receive ink transmitted thereto.

The first supply connector may include a first connector body having a first chamber and a first sealing member installed in the first connector body and having a first orifice connected with the first chamber, the second supply connector may include a second connector body having a second chamber and a second sealing member installed in the second connector body and having a second orifice connected with the second chamber, and a flow-path connecting device may be installed between the first connector body and the second connector body and may include a flow-path tube having one end inserted into the first orifice to thereby be connected with the first chamber and the other end inserted into the second orifice to thereby be connected with the second chamber.

A first valve member to open or close the first orifice and a first valve spring to press the first valve member so as to cause the first valve member to come into contact with the first sealing member may be installed in the first chamber, and a second valve member to open or close the second orifice and a second valve spring to press the second valve member so as to cause the second valve member to come into contact with the second sealing member may be installed in the second chamber.

The second discharge connector may include a third connector body having a third chamber and a third sealing member installed in the third connector body and having a third orifice connected with the third chamber, and the first discharge connector may include an insertion tube to be inserted into the third orifice to thereby be connected with the third chamber.

A third valve member to open or close the third orifice and a third valve spring to press the third valve member so as to cause the third valve member to come into contact with the third sealing member may be installed in the third chamber.

The image forming apparatus may further include: a cradle provided with the head mount and pivotally rotatably mounted at the body.

The head mount may be provided at an upper surface of the body to allow the print head to be installed to or separated from the head mount via vertical movement thereof.

The image forming apparatus may further comprise: a guide to guide installation/separation of the print head.

The guide may include a guiding protrusion protruding from any one of the body and print head, and a guiding hole formed in the other one of the body and print head, into which the guiding protrusion is inserted.

Embodiments of the present general inventive concept also provide an image forming apparatus including: a body; a print head including a nozzle part having a length at least greater than a width of a printable printing medium; a cradle pivotally rotatably mounted at the body and provided with a heat mount to detachably receive the print head; at least one first connector provided at the head mount; and at least one second connector provided at the print head to correspond to the at least one first connector, wherein the first connector and second connector are connected with each other as the print head is mounted to the head mount.

The image forming apparatus may further include: a hinge shaft provided at the cradle to allow the cradle to be pivotally rotatably mounted at the body; and a supporting spring as a torsion spring installed to the hinge shaft to enable upward pivotal rotation of the cradle.

Guide grooves to guide mounting of the print head may be provided at opposite sides of the head mount of the cradle, and the print head may be provided with guide rails to be inserted into the guide grooves.

The image forming apparatus may further include: a detaching lever hingedly coupled to a side surface of the cradle and having a protruding portion formed at one end thereof and configured to be inserted into the head mount through an opening formed in the side surface of the cradle, wherein the print head has a fixing recess formed at a side surface thereof for insertion of the protruding portion.

The image forming apparatus may further include: a detaching spring installed at the side surface of the cradle and used to elastically support the other end of the detaching lever.

The image forming apparatus may further include: fixing protrusions protruding from opposite sides of the cradle; insertion recesses provided at opposite sides of the body, into which the fixing protrusions are inserted as the cradle is pivotally rotated to a closing position; and slide levers slidably movably installed at opposite sides of the body and used to press the fixing protrusions inserted in the insertion recesses downward.

The image forming apparatus may further include: a stopper vertically movably installed in the corresponding slide lever and having a lower end to press an upper end of the fixing protrusion inserted in the insertion recess; and a stopper spring to elastically press the stopper downward.

Embodiments of the present general inventive concept also provide an image forming apparatus including: a body; a print head including a nozzle part having a length at least greater than a width of a printable printing medium; at least one first connector provided at an upper surface of the body; and at least one second connector provided at a lower surface of the print head to correspond to the at least one first connector, wherein the first connector and second connector are connected with each other as the print head is mounted to the body via vertical movement thereof.

BRIEF DESCRIPTION OF THE DRAWINGS

These and/or other features and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
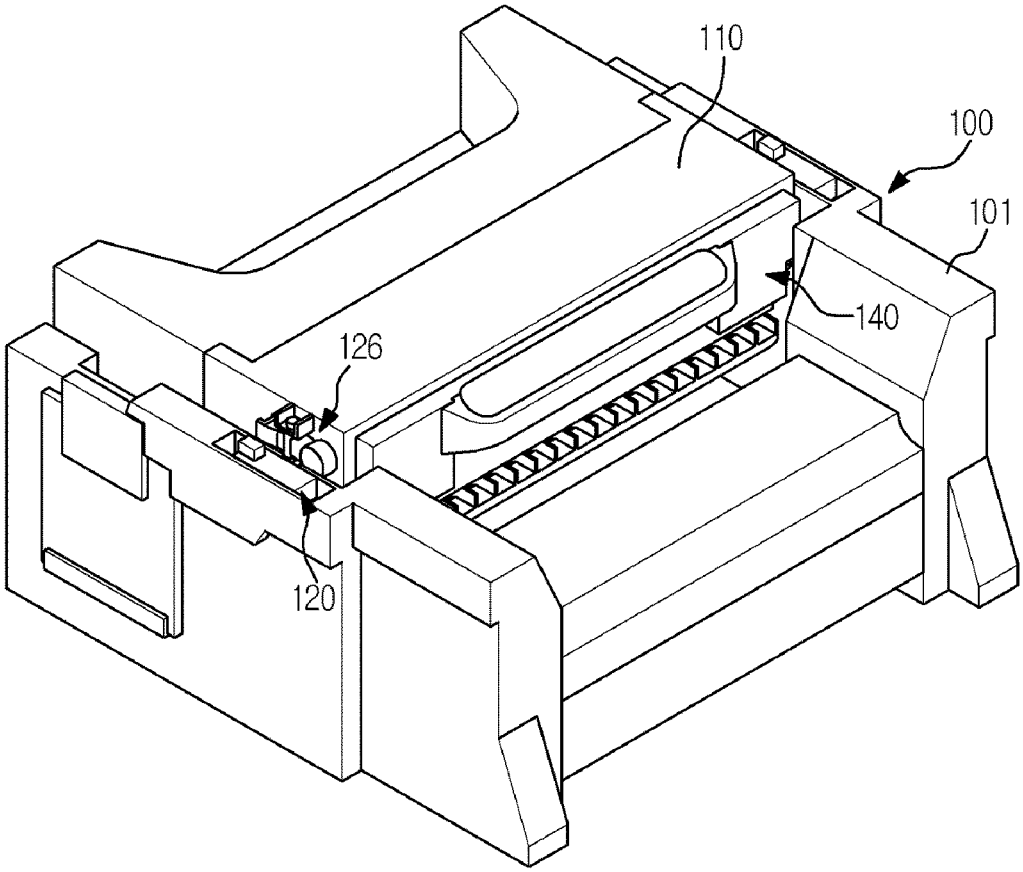
FIG. 1 is a perspective view schematically illustrating an image forming apparatus in accordance with an embodiment of the present general inventive concept.

Reference will now be made in detail to an exemplary embodiment of the present general inventive concept, examples of which are illustrated in the accompanying drawings, wherein like reference numerals refer to like elements throughout. The embodiments are described below to explain the present general inventive concept by referring to the figures.

Hereinafter, an image forming apparatus in accordance with exemplary embodiments of the present invention will be described with reference to the accompanying drawings.

Figure 6:
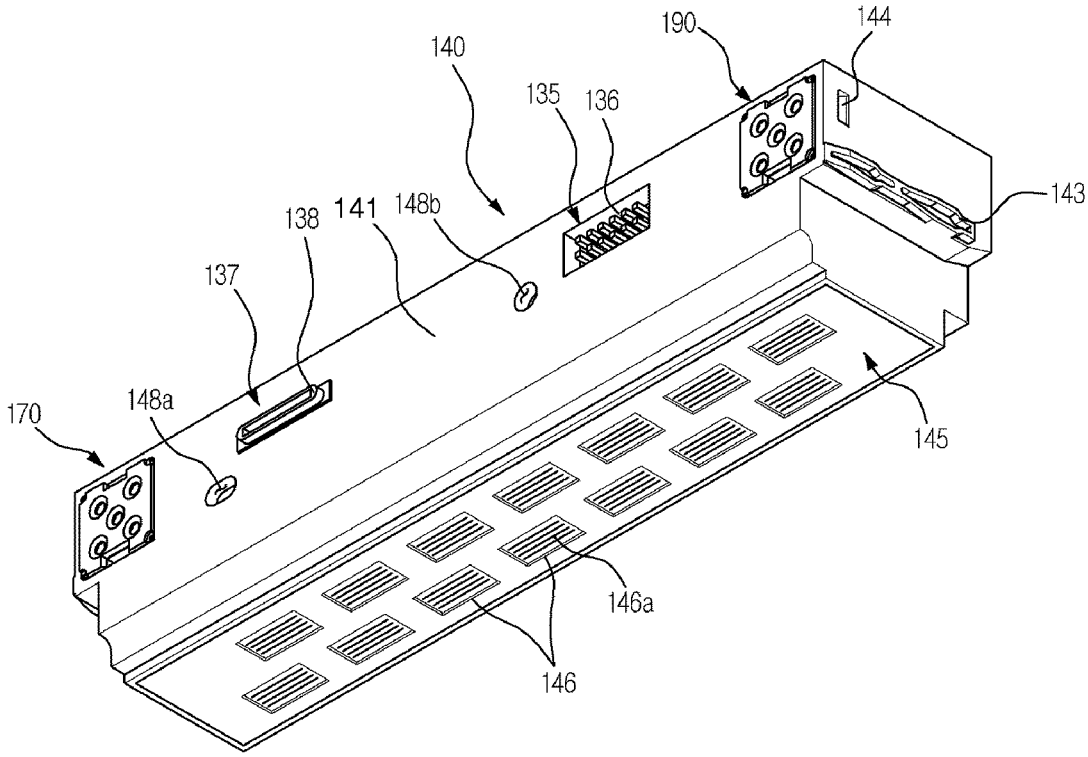
FIG. 6 is a perspective view schematically illustrating the print head of the image forming apparatus in accordance with the embodiment of FIG. 1.

As shown in FIG. 1, the image forming apparatus 100 in accordance with an embodiment of the present general inventive concept includes a body 101, and a print head 140 provided separately from the body 101 and detachably mounted in the body 101 to allow exchange thereof as necessary. A head mount 114 (see FIG. 2), in which the print head 140 is mounted, is located in an upper region of the body 101. The print head 140, as shown in FIG. 6, is an array type print head 140 in which nozzles 146*a* have a total length at least greater than a width of a printable printing medium. Here, the array type print head 140 may be a single print head 140 having a length substantially corresponding to a width of a printing medium, or may be a plurality of print heads 140 having a total length substantially corresponding to a width of a printing medium. In the present embodiment, the print head 140 includes a plurality of head chips 146 each having the nozzle 146*a* such that the nozzles 146*a* have a total length corresponding to a width of a printing medium.

Figure 2:
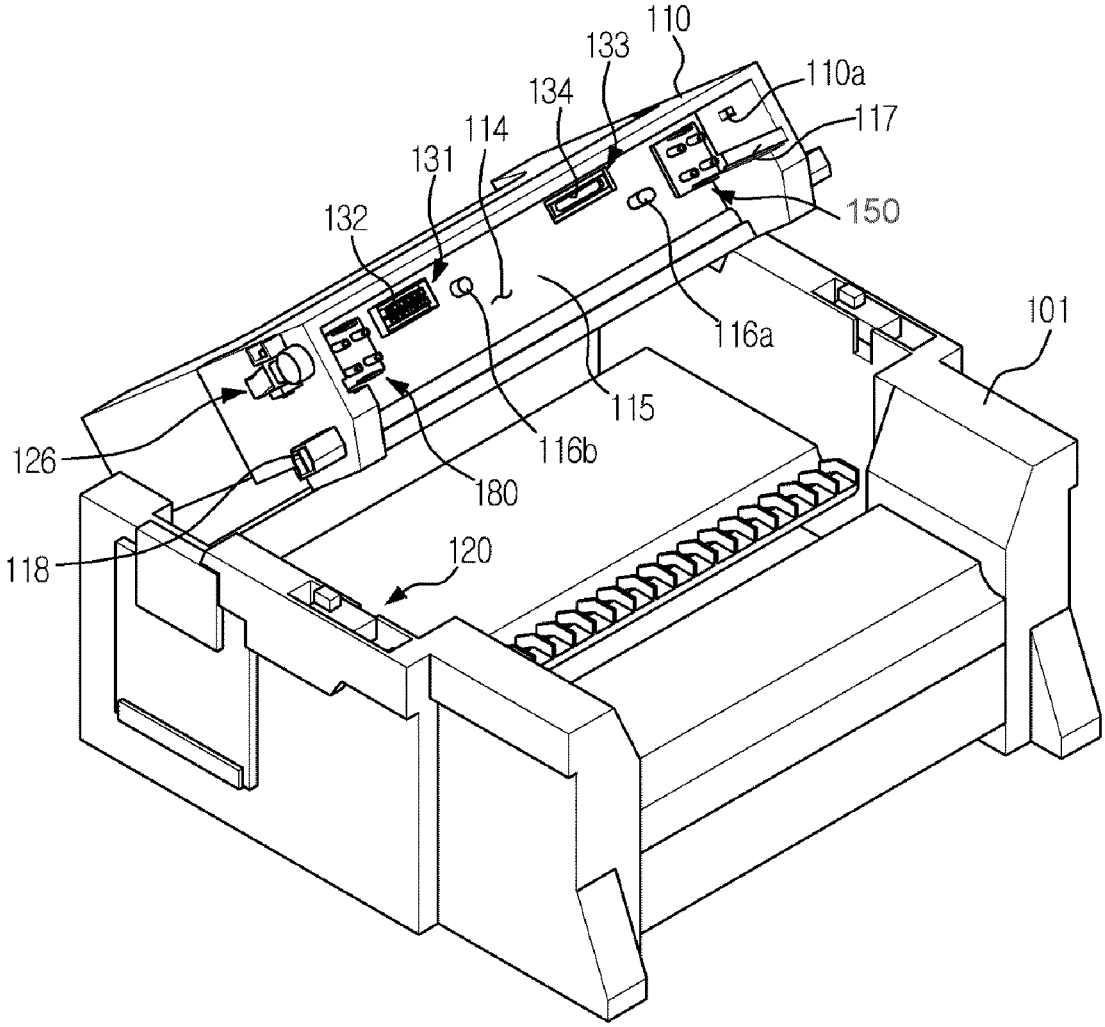
FIG. 2 is a perspective view of the image forming apparatus in accordance with the embodiment of FIG. 1, illustrating a state wherein a print head is separated from a cradle.

As shown in FIG. 2, a cradle 110 to allow the print head 140 to be easily mounted to the body 101 is pivotally rotatably mounted in the upper region of the body 101. The above-described head mount 114 is provided in the cradle 110.

The body 101 incorporates a variety of rollers (not shown) to deliver a printing medium, a motor (not shown) to operate the rollers, a power source (not shown) to supply power, a maintenance device (not shown) to manage the ink ejecting nozzles 146*a* of the print head 140 to assure efficient ejection of ink through the nozzles 146*a*, and a controller (not shown) to control general operations of the image forming apparatus 100, and the like. The above-mentioned components are conventionally provided in the image forming apparatus 100 and thus, a detailed description thereof will be omitted.

Figure 3:
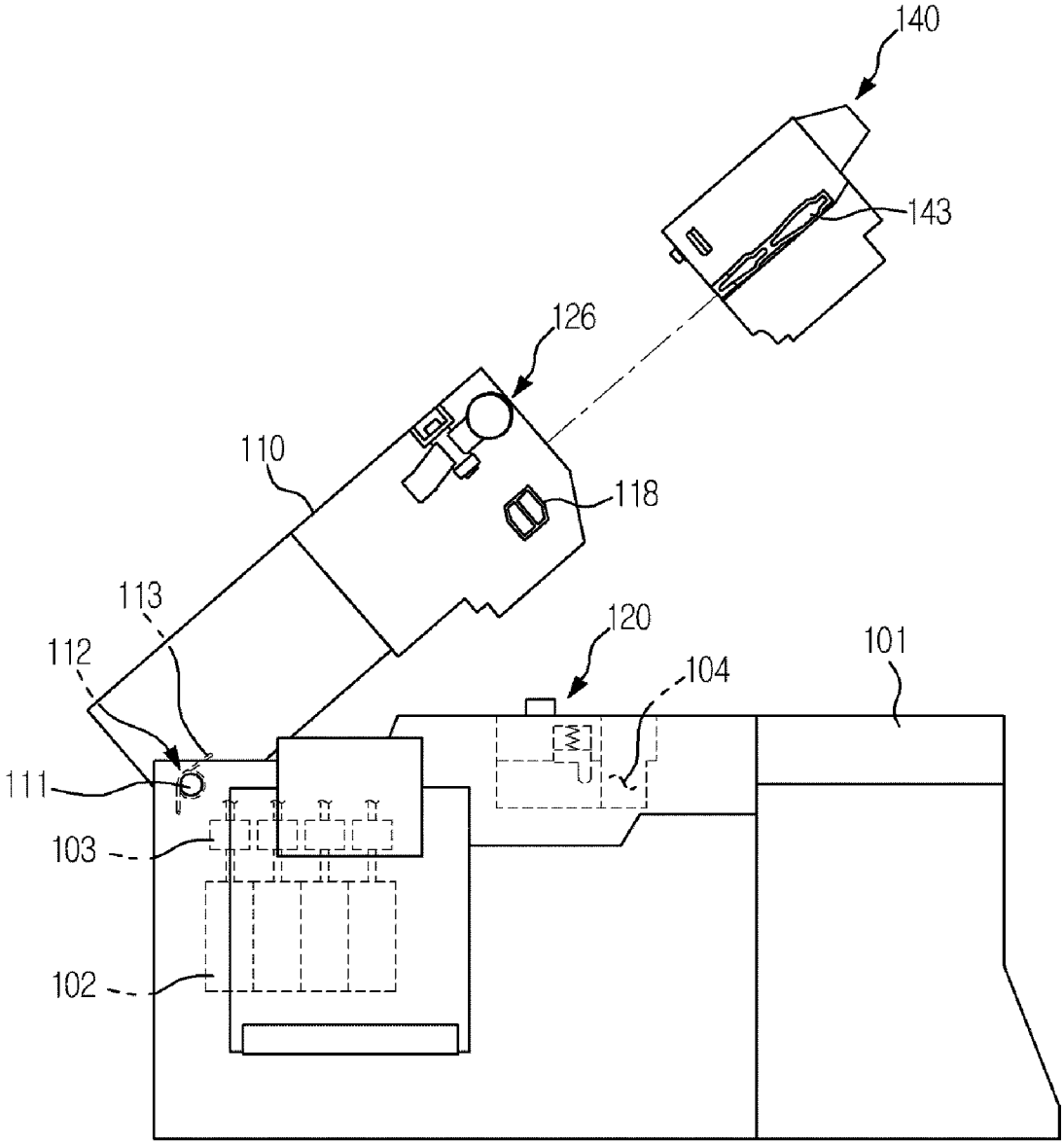
FIG. 3 is a schematic side view of the image forming apparatus in accordance with the embodiment of FIG. 1.

As illustrated in FIG. 3, the body 101 further incorporates an ink tank 102 to store different colors of ink (for example, black, magenta, cyan, and yellow ink) separately, and a regulator 103 disposed between the ink tank 102 and the print head 140. The regulator 103 serves to apply a negative pressure to ink so as to supply an appropriate amount of ink into the print head 140 only when the print head 140 ejects ink.

The cradle 110 is installed in the upper region of the body 101 such that it is pivotally rotatable by a predetermined angle. Rear ends of both side surfaces of the cradle 110 are supported, by hinge shafts 111, at the body 101. The hinge shafts 111 may be provided at the body 101, or may be provided at the cradle 110. When the hinge shafts 111 are provided at the body 101, the cradle 110 has hinge portions (not shown) to couple the hinge shafts 111. When the hinge shafts 111 are provided at the cradle 110, the body 101 has the hinge portions to couple the hinge shafts 111.

To pivotally rotate the cradle 110, the body 101 is provided with a pivoting device 112. The pivoting device 112 includes a pair of supporting springs 113, which are torsion springs installed around the respective hinge shafts 111. Each of the supporting springs 113 has one end coupled to the body 101 and the other end coupled to the cradle 110. Each supporting spring 113 applies an elastic force to the cradle 110 to cause a front end of the cradle 110 to be lifted. The elastic force of each supporting spring 113 has strength sufficient to pivotally rotate the cradle 110 to an opening position where the top of the body 101 is exposed.

Here, the opening position of the cradle 110, as shown in FIG. 2, is a position where the front end of the cradle 110 is lifted to expose the top of the body 101 to the outside. In the present embodiment, the cradle 110 has an angle of about 45 degrees relative to the ground surface at the opening position. Once the cradle 110 is pivotally rotated to the opening position, a user can easily couple or separate the print head 140 into or from the head mount 114 of the cradle 110. Further, even when a printing medium is jammed during printing, it is easy to remove the jammed printing medium from the body 101.

Figure 4:
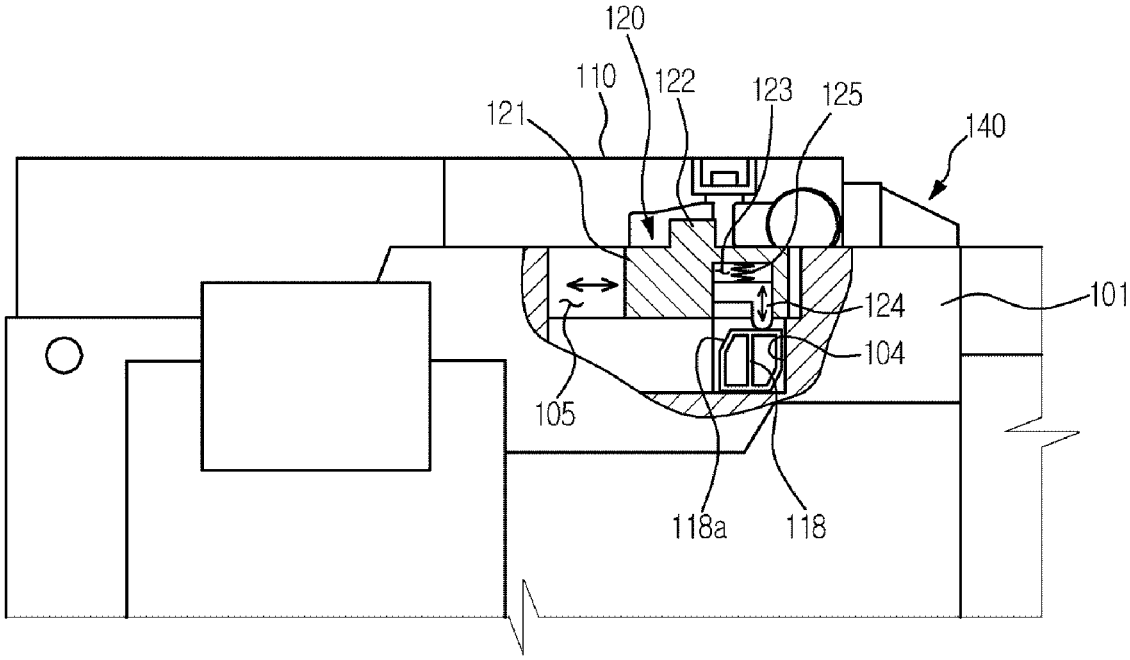
FIG. 4 is a side view of the image forming apparatus in accordance with the embodiment of FIG. 1, illustrating the cradle moved to a closing position thereof.

In consideration of the fact that the cradle 110 is elastically forced by the pair of supporting springs 113 such that the front end of the cradle 110 is lifted, the body 101 is provided with a pair of fixing devices 120 to fix the cradle 110 at a closing position where the cradle 110 is horizontal to the ground surface. Each of the fixing devices 120, as shown in FIG. 4, includes a slide lever 121 installed in a slide recess 105 defined in either side surface of the body 101 to slidably move forward and rearward, and a stopper 124 vertically movably installed in a mounting recess 123 defined in the slide lever 121. A stopper spring 125 is also installed in the mounting recess 123, to apply an elastic force to the stopper 124 downward.

If the user pushes the cradle 100 to move the cradle 100 to the closing position, fixing protrusions 118 provided at opposite sides of the cradle 110 are inserted into insertion recesses 104 formed at opposite sides of the body 101 to correspond to the fixing protrusions 118. If the user pushes a grip 122 of each slide lever 121 forward, the stopper 124 is brought into contact with the corresponding fixing protrusion 118 of the cradle 110 inserted in the insertion recess 104. In this case, the stopper 124 presses the fixing protrusion 118 so as to fix the cradle 110 at the closing position. The fixing protrusion 118 has a slope 118*a*. If the user pushes the slide lever 121 after moving the cradle 110 to the closing position, the stopper 124 rises along the slope 118*a* and is positioned at the top of the fixing protrusion 118. Then, if the user pushes the slide lever 121 rearward in a state wherein the stopper 124 presses the fixing protrusion 118 of the cradle 110, the stopper 124 is separated from the fixing protrusion 118, allowing the cradle 110 to be pivotally rotated to the opening position by the elastic force of the supporting springs 113.

In exemplary embodiments, the pivoting device 112 to pivotally rotate the cradle 110 may be selected from a variety of devices capable of pivotally rotating the cradle 110 by a predetermined angle, such as a gear device or cylinder device, except for the supporting springs 113.

The cradle 110 has the head mount 114 capable of receiving the print head 140, and the head mount 114 has an open bottom. Once the print head 140 is coupled into the head mount 114, a head-chip assembly 145 (see FIG. 6) at the bottom of the print head 140 is exposed to the outside through the open bottom of the head mount 114.

In the present embodiment, the print head 140 is designed to be operated upon receiving power and signals from the body 101 as well as ink from the ink tank 102 and regulator 103 which are provided separately from the print head 140 and mounted in the body 101.

Accordingly, as shown in FIG. 2, the head mount 114 is provided with a plurality of first connectors 131, 133, 150 and 180, to transmit ink, power and signals to the print head 140.

The first connectors 131, 133, 150 and 180 include a first power connector 131 to supply power to the print head 140, a first signal connector 133 to transmit signals to the print head 140, and a first supply connector 150 and a first discharge connector 180 to cause flow of ink between the ink tank 102 and the print head 140. The first supply connector 150 supplies ink toward the print head 140, and the first discharge connector 180 withdraws the ink of the print head 140.

The first supply connector 150 connects the regulator 103 mounted in the body 101 with the print head 140 in an ink flow manner. The first discharge connector 180 connects the ink tank 102 mounted in the body 101 with the print head 140 in an ink flow manner.

The first power connector 131, first signal connector 133, first supply connector 150, and first discharge connector 180 are horizontally arranged at a rear wall 115 of the head mount 114 inside the cradle 110 so as to be exposed in a forward direction with respect to the body 101. A plurality of coupling protrusions 116*a* and 116*b* protrude forward from the rear wall 115. The first power connector 131 has a plurality of terminal holes 132, and the first signal connector 133 has a single terminal hole 134. The first power connector 131 and first signal connector 133 may have any other type of configuration, similar to conventional connectors, suitable to supply power or signals.

Detailed configurations of the first supply connector 150 and first discharge connector 180 will be described hereinafter when dealing with a second supply connector 170 and a second discharge connector 190 provided at the print head 140.

Figure 5:
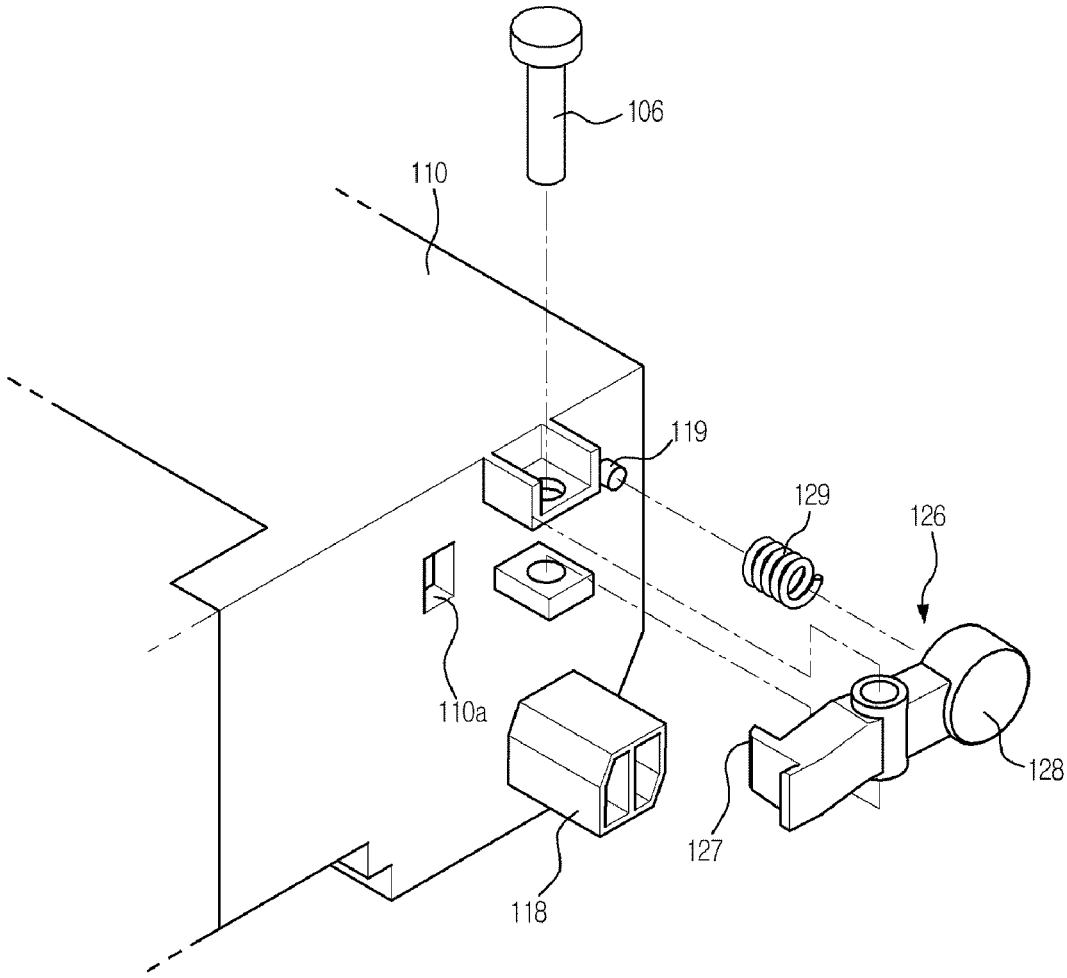
FIG. 5 is an exploded perspective view illustrating a detaching lever of the image forming apparatus in accordance with the embodiment of FIG. 1.

Both side surfaces of the head mount 114 inside the cradle 110 are provided with guide grooves 117 to guide the print head 140 when the print head 140 is coupled into the head mount 114. The guide grooves 117 are horizontally formed to allow the print head 140 to be horizontally coupled into the head mount 114. Detaching levers 126 are provided at both the side surfaces of the cradle 110, to maintain the print head 140 coupled in the head mount 114. Each detaching lever 126, as shown in FIG. 5, is hingedly coupled to either side surface of the cradle 110 by means of a supporting shaft 106. One end of the detaching lever 126 is formed with a protruding portion 127, which can be inserted into the head mount 114 through an opening 110*a* perforated in the corresponding side surface of the cradle 110. The other end of the detaching lever 126 is provided with a button 128 for manual operation by the user.

The other end of the detaching lever 126 is subjected to an elastic force of a detaching spring 129 installed to an outer surface of the cradle 110. The detaching spring 129 is installed to a spring fixing protrusion 119 provided at the cradle 110, and is used to press the button 128 of the detaching lever 126. Accordingly, the protruding portion 127 of the detaching lever 126 is kept at a position inserted into the head mount 114 through the opening 110*a* of the cradle 110, and is separated from the head mount 114 only when the user pushes the button 128. Once the print head 140 is coupled into the head mount 114, the print head 140 is caught by the protruding portions 127 of both the detaching levers 126, so as not to be easily separated from the head mount 114.

The print head 140 is detachably coupled in the cradle 110. As shown in FIG. 6, the print head 140 includes a head body 141, a head-chip assembly 145 provided at the bottom of the head body 141, and a plurality of second connectors 135, 137, 170 and 190 connected, respectively, with the plurality of first connectors 131, 133, 150 and 180 provided at the head mount 114 of the body 101.

The plurality of second connectors 135, 137, 170 and 190 provided at the print head 140 include a second power connector 135 connected with the first power connector 131 to receive power, a second signal connector 137 connected with the first signal connector 133 to receive signals from the body 101, a second supply connector 170 connected with the first supply connector 150 to receive ink, and a second discharge connector 190 connected with the first discharge connector 180 to receive the ink discharged from the print head 140.

The head body 141 is provided at a front surface thereof with a handle 142 for manual operation by the user, and at both side surfaces thereof with guide rails 143 corresponding to the guide grooves 117 of the cradle 110. The guide rails 143 extend lengthwise in a horizontal direction of the head body 141 so as to be inserted into and straightly move along the guide grooves 117. Both the side surfaces of the head body 141 are also provided, respectively, with fixing recesses 144 corresponding to the protruding portions 127 of the detaching levers 126. When the print head 140 is coupled into the head mount 114 of the cradle 110, the protruding portions 127, inserted into the head mount 114, are caught by the fixing recesses 144, preventing the print head 140 from being easily separated from the head mount 114. Although not shown, the head body 141 is internally defined with ink channels for movement of ink. The ink channels connect the head-chip assembly 145, second supply connector 170, and second discharge connector 190 with one another.

The head-chip assembly 145 includes a plurality of head chips 146. In the present embodiment, the image forming apparatus 100 is of an array type including the plurality of head chips 146 arranged in rows at a lower surface of the head chip assembly 145. Each of the head-chips 146 includes a plurality of nozzles 146*a* to eject ink, and drivers (not shown) such as heaters or piezoelectric elements to generate an ink ejection force to allow ink to be ejected through the nozzles 146*a*. The head-chip assembly 145 is exposed to the interior of the body 101 through the open bottom of the cradle 110 when the print head 140 is mounted in the cradle 110.

The second power connector 135, second signal connector 137, second supply connector 170, and second discharge connector 190 are horizontally arranged at a rear wall 147 of the head body 141, to correspond to the first power connector 131, first signal connector 133, first supply connector 150, and first discharge connector 180, respectively. With this arrangement, by simply inserting the print head 140 into the head mount 114, the user can couple the second power connector 135, second signal connector 137, second supply connector 170, and second discharge connector 190, with the first power connector 131, first signal connector 133, first supply connector 150, and first discharge connector 180 of the body 101, respectively, without separate manual operation by the user.

The rear wall 147 of the head body 141 is provided with a plurality of coupling recesses 148*a* and 148*b* corresponding to the plurality of coupling protrusions 116*a* and 116*b* of the cradle 110. When the print head 140 is coupled into the head mount 114, the coupling protrusions 116*a* and 116*b* are inserted into the respective coupling recesses 148*a* and 148*b*.

The second power connector 135 has a plurality of terminal pins 136 for communication of electricity. As the plurality of terminal pins 136 are inserted into the plurality of terminal holes 132 of the first power connector 131, the first power connector 131 and second power connector 135 are mechanically coupled, and at the same time, are electrically connected with each other. The second signal connector 137 has a single terminal 138 for communication of electricity. As the terminal 138 is inserted into the terminal hole 134 of the first signal connector 133, the first signal connector 133 and second signal connector 137 are mechanically and electrically connected with each other.

Figure 7:
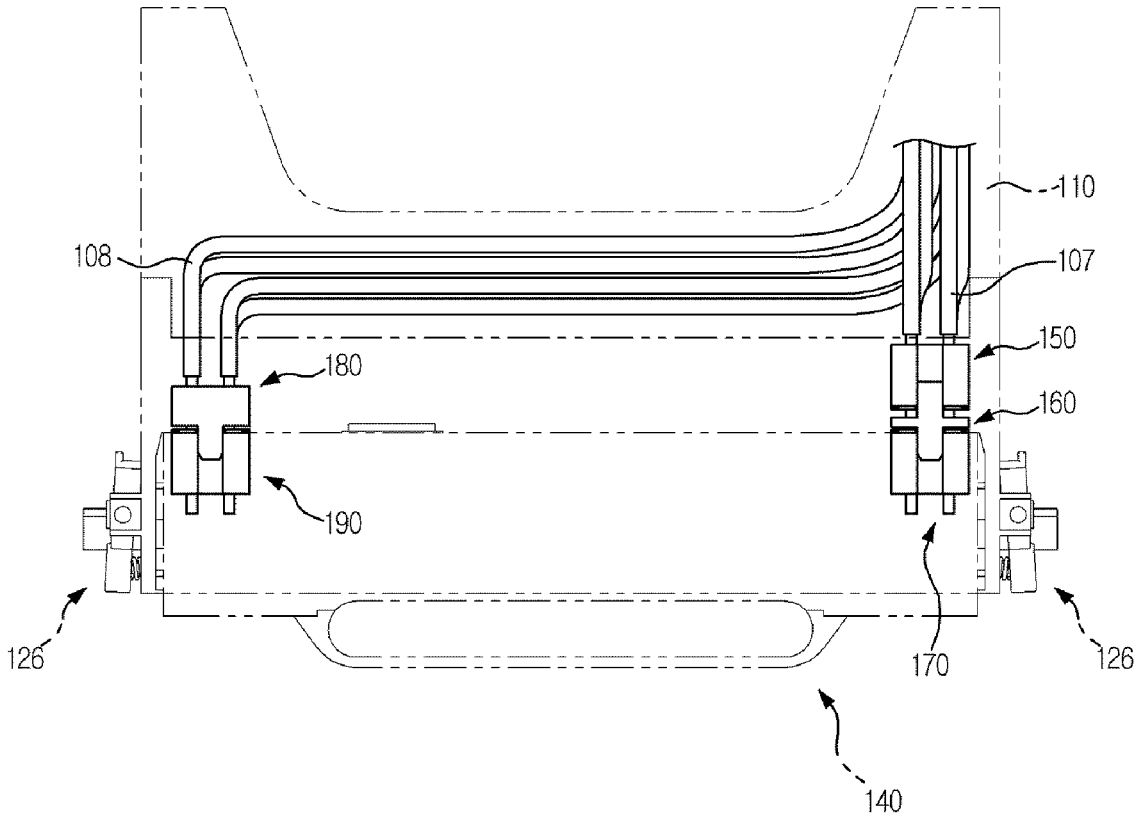
FIG. 7 is a plan view illustrating a coupled state of the print head and cradle of the image forming apparatus in accordance with the embodiment of FIG. 1.

As shown in FIG. 7, the second supply connector 170 is connected with the first supply connector 150 of the body 101, to supply the ink stored in the ink tank (102, See FIG. 3) into the print head 140. The second discharge connector 190 is connected with the first discharge connector 180 of the body 101, to discharge the ink from the print head 140 into the ink tank 102. The first supply connector 150 is coupled with a plurality of ink supply tubes 107, which are in turn connected with the regulator 103 (See FIG. 3). The first discharge connector 180 is coupled with a plurality of ink discharge tubes 108, which are in turn connected with the ink tank 102. The second supply connector 170 and the second discharge connector 190 have the same configuration.

An ink pump (not shown) is installed midway through the ink discharge tubes 108, to circulate ink between the print head 140 and the ink tank 102. In the present embodiment, the ink pump does not have any special characteristics, and may be a conventional ink pump capable of circulating ink. By operating the ink pump, it is possible to collect ink that will be coagulated in the print head 140 or contains air and also, to supply normal ink stored in the ink tank 102 into the print head 140.

Figure 8:
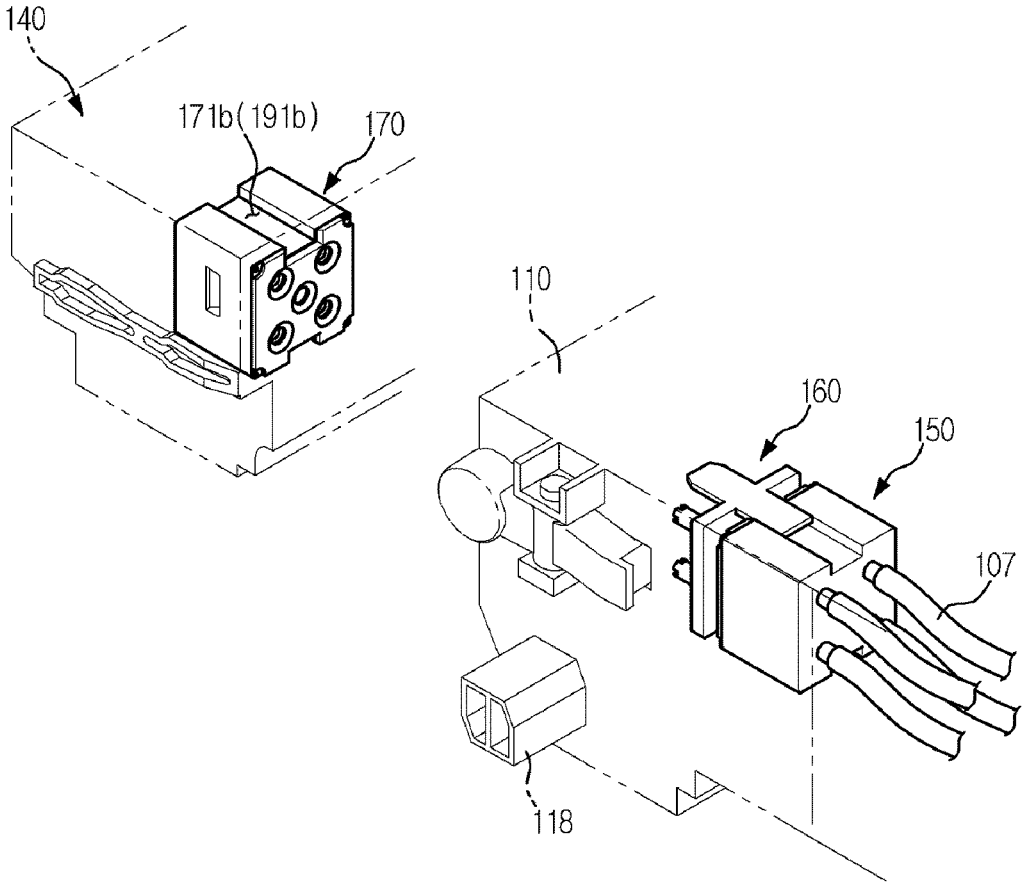
FIG. 8 is a perspective view schematically illustrating first and second supply connectors of the image forming apparatus in accordance with the embodiment of FIG. 1.

As shown in FIG. 8, the first supply connector 150 includes a first connector body 151, which is coupled to the cradle 110 and is connected with the plurality of ink supply tubes 107. A flow-path connecting device 160 is installed at a front side of the first connector body 151, to connect the first supply connector 150 and second supply connector 170 with each other. The second supply connector 170 includes a second connector body 171 coupled to the print head 140. The second connector body 171 is provided, at a side surface thereof, with a plurality of connecting tubes 172 connected to the ink channels (not shown) of the print head 140.

Figure 9:
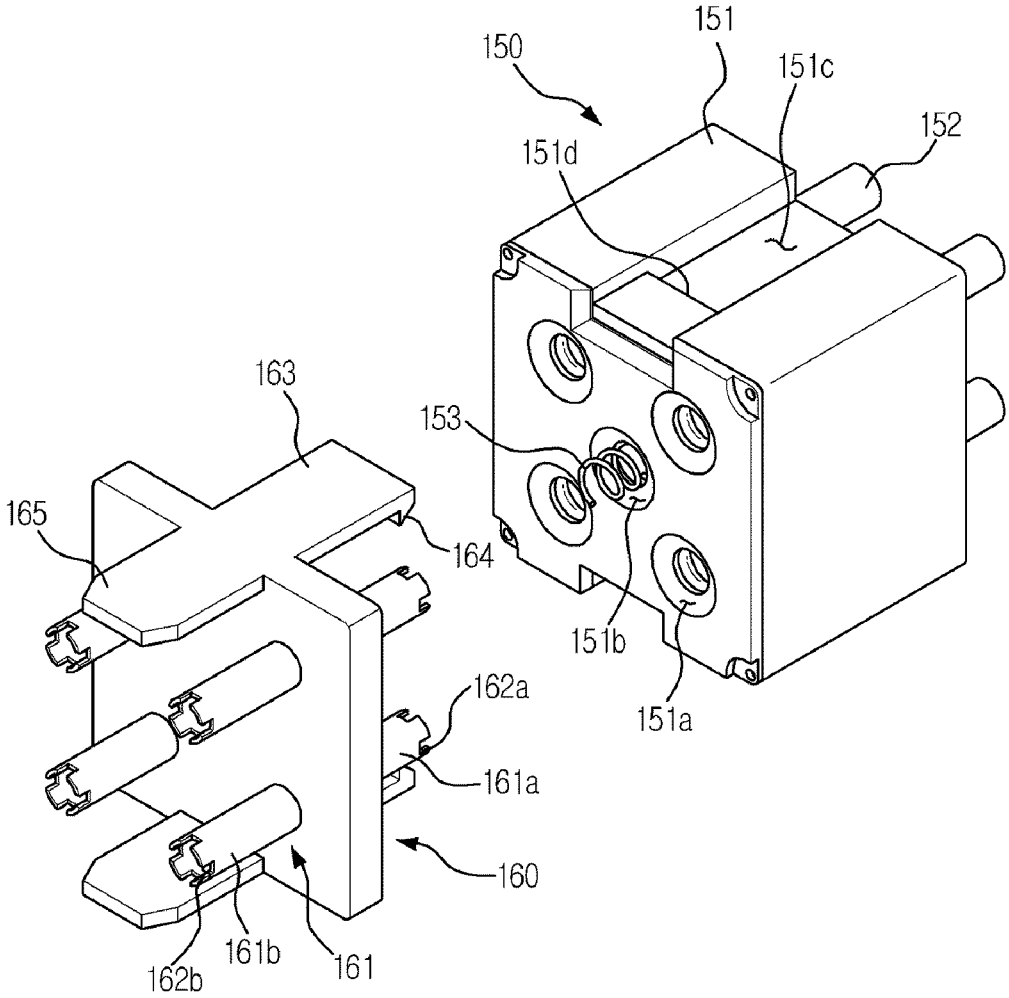
FIG. 9 is a perspective view schematically illustrating a first supply connector and a flow-path connecting device of the image forming apparatus in accordance with the embodiment of FIG. 1.
Figure 10:
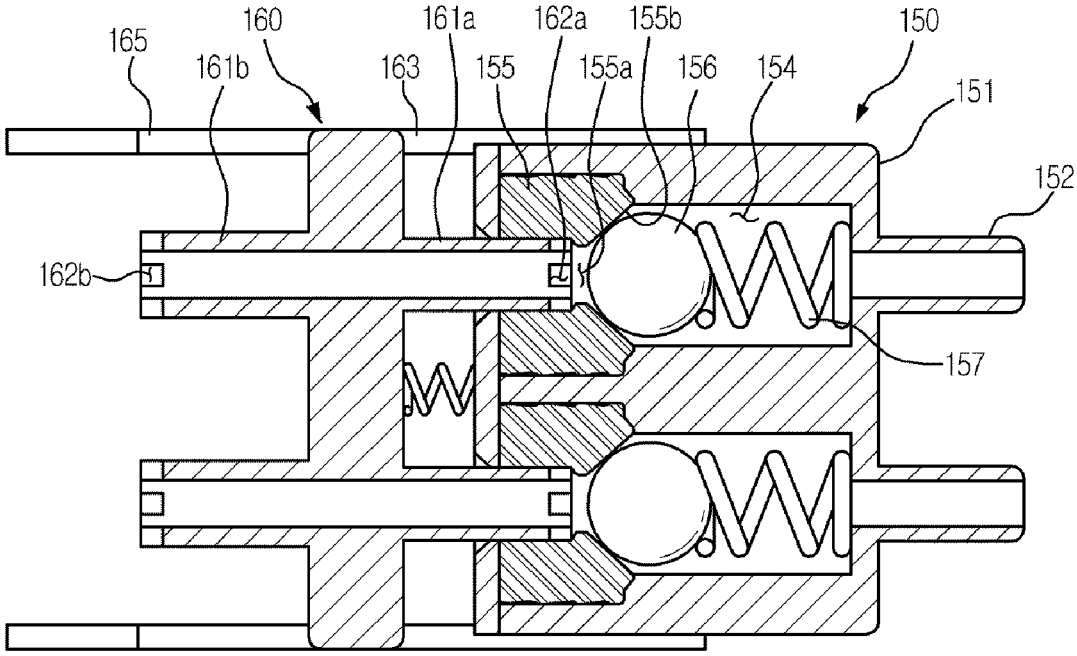
FIG. 10 is a side sectional view illustrating a coupled state of the first supply connector and flow-path connecting device of the image forming apparatus in accordance with the embodiment of FIG. 1.

As shown in FIGS. 9 and 10, the first supply connector 150 includes the first connector body 151, and a plurality of first sealing members 155 and a plurality of first valve members 156 installed in the first connector body 151.

As shown in FIG. 9, one side surface of the first connector body 151 is provided with a plurality of connecting tubes 152, to which the plurality of ink supply tubes 107 are coupled. The other side surface of the first connector body 151 is provided with a plurality of first connecting holes 151*a* corresponding to the plurality of connecting tubes 152 and a mounting recess 151*b*. The mounting recess 151*b* is located approximately at the center of the first connector body 151, and a return spring 153 is mounted in the mounting recess 151*b*. The first connector body 151 has first guide grooves 151*c* formed at upper and lower outer surfaces of the first connector body 151. Each of the first guide grooves 151*c* has a stepped portion 151*d*.

The flow-path connecting device 160 is coupled to the other surface of the first connector body 151 having the first connecting holes 151*a*. The flow-path connecting device 160 has a plurality of flow-path tubes 161. Each of the flow-path tubes 161 includes a first tube 161*a*, which protrudes rearward so as to be inserted into a corresponding one of the plurality of first connecting holes 151*a*, and a second tube 161*b*, which protrudes forward so as to be connected with the first tube 161*a*. The first tube 161*a* is formed at a distal end thereof with first inlet holes 162*a*, and the second tube 161*b* is formed at a distal end thereof with second inlet holes 162*b*. The first tube 161*a* has a smaller outer diameter than an outer diameter of the second tube 161*b*. The flow-path connecting device 160 is formed at the top and bottom thereof with first guide bars 163 protruding rearward similar to the first tubes 161*a*, and second guide bars 165 protruding forward similar to the second tubes 161*b*. Each of the first guide bars 163 is formed at a distal end thereof with a hook 164.

The pair of first guide bars 163 are inserted into the pair of first guide grooves 151*c*, respectively, in a slidably movable manner. When the flow-path connecting device 160 moves forward and becomes more distant from the first supply connector 150, the first guide bars 163 slidably move along the respective first guide grooves 151*c*. If the hooks 164 of the first guide bars 163 are caught by the stepped portions 151*d* of the first guide grooves 151*c* as the first guide bars 163 move forward, the first guide bars 163 are stopped and cannot move further. As the hooks 164 of the first guide bars 163 are caught by the stepped portions 151*d*, the flow-path connecting device 160 cannot be separated from the first supply connector 150.

When the flow-path connecting device 160 is coupled to the first supply connector 150, the return spring 153 installed at the other side surface of the first connector body 151 applies an elastic force to the flow-path connecting device 160. With the elastic operation of the return spring 153, the plurality of first tubes 161*a* of the flow-path connecting device 160 are kept at positions separated from the plurality of first connecting holes 151*a* of the first connector body 151.

As shown in FIG. 10, the first connector body 151 internally defines a plurality of first chambers 154, through which the plurality of connecting tubes 152 and the plurality of connecting holes 151*a* are connected to each other. The ink, supplied through the connecting tubes 152, can move to the first connecting holes 151*a* through the first chambers 154. The first sealing members 155 are installed between the first chambers 154 and the first connecting holes 151*a*. Each of the first sealing members 155 has a first orifice 155*a* for movement of ink, and a first seat 155*b* to come into close contact with the first valve member 156 to close the first orifice 155*a*. The first sealing member 155 is made of an elastic material such as rubber or silicone. If the first valve member 156 comes into close contact with the first seat 155*b*, the first orifice 155*a* is closed to prevent movement of ink.

The plurality of first valve members 156 are movably installed in the respective first chambers 154 such that they are selectively brought into contact or separated from the respective first sealing members 155. Each of the first chambers 154 is provided with a first valve spring 157, to cause the first valve member 156 to come into close contact with the first seat 155*b* of the first sealing member 155. If the first tubes 161*a* of the flow-path connecting device 160 are not inserted into the first chambers 154, the first valve members 156 come into close contact with the first seats 155*b*, preventing movement of ink through the first orifices 155*a*.

Figure 11:
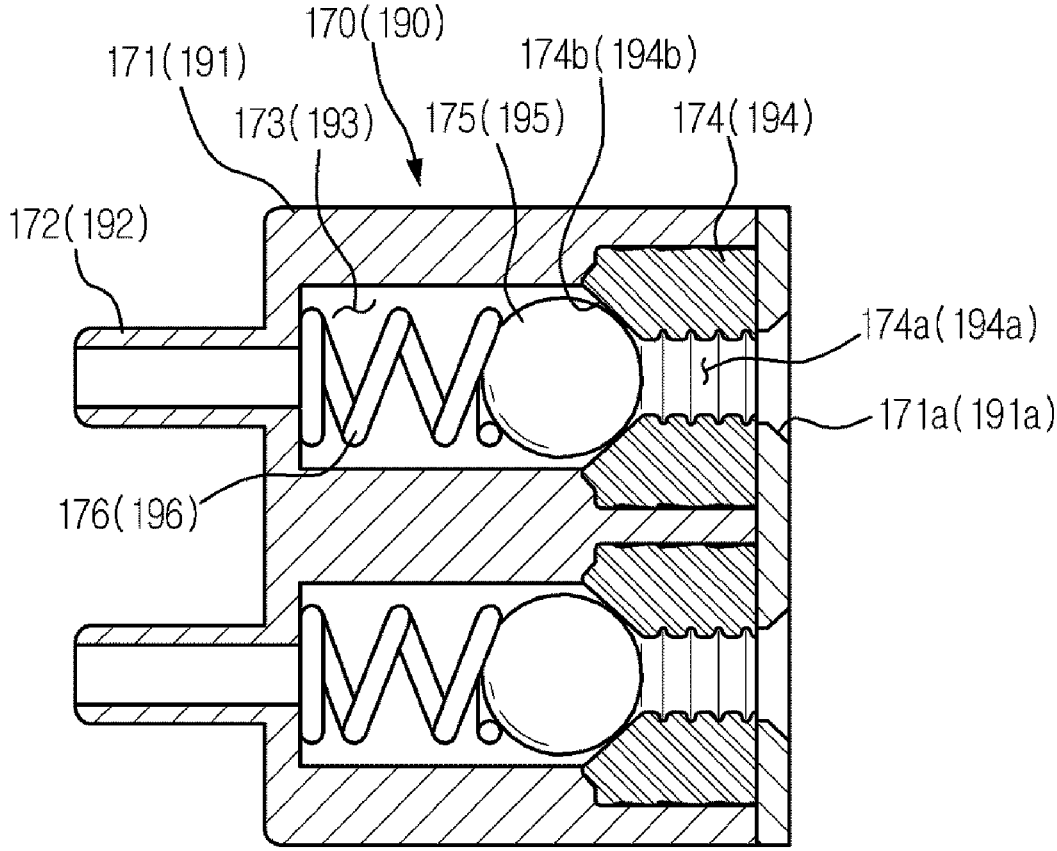
FIG. 11 is a side sectional view schematically illustrating a second supply connector of the image forming apparatus in accordance with the embodiment of FIG. 1.

As shown in FIG. 11, the second supply connector 170 includes the second connector body 171, and a plurality of second sealing members 174 and a plurality of second valve members 175 which are installed in the second connector body 171.

The plurality of connecting tubes 172 are provided at one side surface of the second connector body 171, and a plurality of second connecting holes 171*a* are formed at the other side surface of the second connector body 171 to correspond to the plurality of connecting tubes 172. The second connector body 171 has second guide grooves (171*b*, See FIG. 8) formed at upper and lower outer surfaces thereof, such that the second guide bars 165 of the flow-path connecting device 160 are slidably movably inserted into the second guide grooves 171*b*. When the second supply connector 170 is coupled with the flow-path connecting device 160, the second guide bars 165 are inserted into the second guide grooves 171*b* to slidably move along the second guide grooves 171*b*, enabling stable coupling of the second supply connector 170 and the flow-path connecting device 160.

As shown in FIG. 11, the second connector body 171 internally defines a plurality of second chambers 173, through which the plurality of connecting tubes 172 and the plurality of connecting holes 171*a* are connected to each other. The plurality of second sealing members 174 are installed between the second chambers 173 and the second connecting holes 171*a*. Each of the second sealing members 174 has a second orifice 174*a* for movement of ink, and a second seat 174*b* to come into close contact with the second valve member 175 to close the second orifice 174*a*. The second sealing member 174 is made of an elastic material such as rubber or silicone, similar to the first sealing member 155.

The plurality of second valve members 175 are movably installed in the respective second chambers 173 such that they are selectively brought into contact or separated from the respective second sealing members 174. Each of the second chambers 173 is provided with a second valve spring 176, to cause the second valve member 175 to come into close contact with the second seat 174*b* of the second sealing member 174. If the second tubes 161*b* do not push the second valve members 175, the second valve members 175 come into close contact with the second seats 174*b*, preventing movement of ink through the second orifices 174*a*.

The second sealing members 174 of the second supply connector 170 have a higher hardness than the first sealing members 155 of the first supply connector 150. Therefore, when the first supply connector 150 and second supply connector 170 are disconnected from each other, in consideration of the higher hardness of the second sealing members 174 than that of the first sealing members 155, the second tubes 161*b* must be separated from the second chambers 173 after the first tubes 161*a* are separated from the first chambers 154.

Upon disconnection of the first supply connector 150 and second supply connector 170, if the second tubes 161*b* are first separated from the second chambers 173 in a state wherein the first tubes 161*a* are still inserted in the first chambers 154, there is a risk of outside air being introduced into the regulator 103 through the flow-path tubes 161, first chambers 154, connecting tubes 152 and ink supply tubes 107. In this case, negative pressure of ink in the regulator 103 is eliminated, causing a predetermined amount of ink to be sprayed through the nozzles 146*a* of the print head 140 when the first supply connector 150 and second supply connector 170 are again connected to each other. Therefore, upon disconnection of the first supply connector 150 and second supply connector 170, it is important that the second tubes 161*b* be separated from the second chambers 173 of the second supply connector 170 after the first tubes 161*a* are separated from the first chambers 154 of the first supply connector 150.

Further, in consideration of the higher hardness of the second sealing members 174 than that of the first sealing members 155, when the first supply connector 150 and second supply connector 170 are connected to each other via the flow-path connecting device 160, the second tubes 161*b* must be connected to the second chambers 173 after the first tubes 161*a* are connected to the first chambers 154. If the first tubes 161*a* are connected to the first chambers 154 after the second tubes 161*b* are connected to the second chambers 173, there is a risk of outside air being introduced into the print head 140 through the flow-path tubes 161, second chambers 173, and connecting tubes 172.

There are a variety of methods to make a force required to connect or disconnect the first tubes 161*a* to or from the first chambers 154 lower than a force required to connect or disconnect the second tubes 161*b* to or from the second chambers 173. For example, as described above, when the second tubes 161*b* have a larger outer diameter than that of the first tubes 161*b*, the second tubes 161*b* can be separated from the second chambers 173 after the first tubes 161*a* are separated from the first chambers 154. As another similar example, the first and second tubes 161*a* and 161*b* may have the same outer diameter, but the first orifice 155*a* may have a larger diameter than that of the second orifice 174*a*.

The second discharge connector 190 has the same configuration as the second supply connector 170. Specifically, the second discharge connector 190, as shown in FIG. 11, includes a third connector body 191 having a plurality of third connecting holes 191*a* and a plurality of third chambers 193, and a plurality of third sealing members 194 and a plurality of third valve members 195 which are installed in the plurality of third chambers 193. Each of the third sealing members 194 has a third orifice 194*a* and a third seat 194*b*. Each of the third chambers 193 is provided with a third valve spring 196 to push the third valve member 195, so as to cause the third valve member 195 to come into close contact with the third seat 194*b*.

A plurality of connecting tubes 192 are provided at one side surface of the third connector body 191. The third connector body 191 also has a pair of third guide grooves (191*b*, See FIG. 8) formed at upper and lower outer surfaces thereof.

Figure 12:
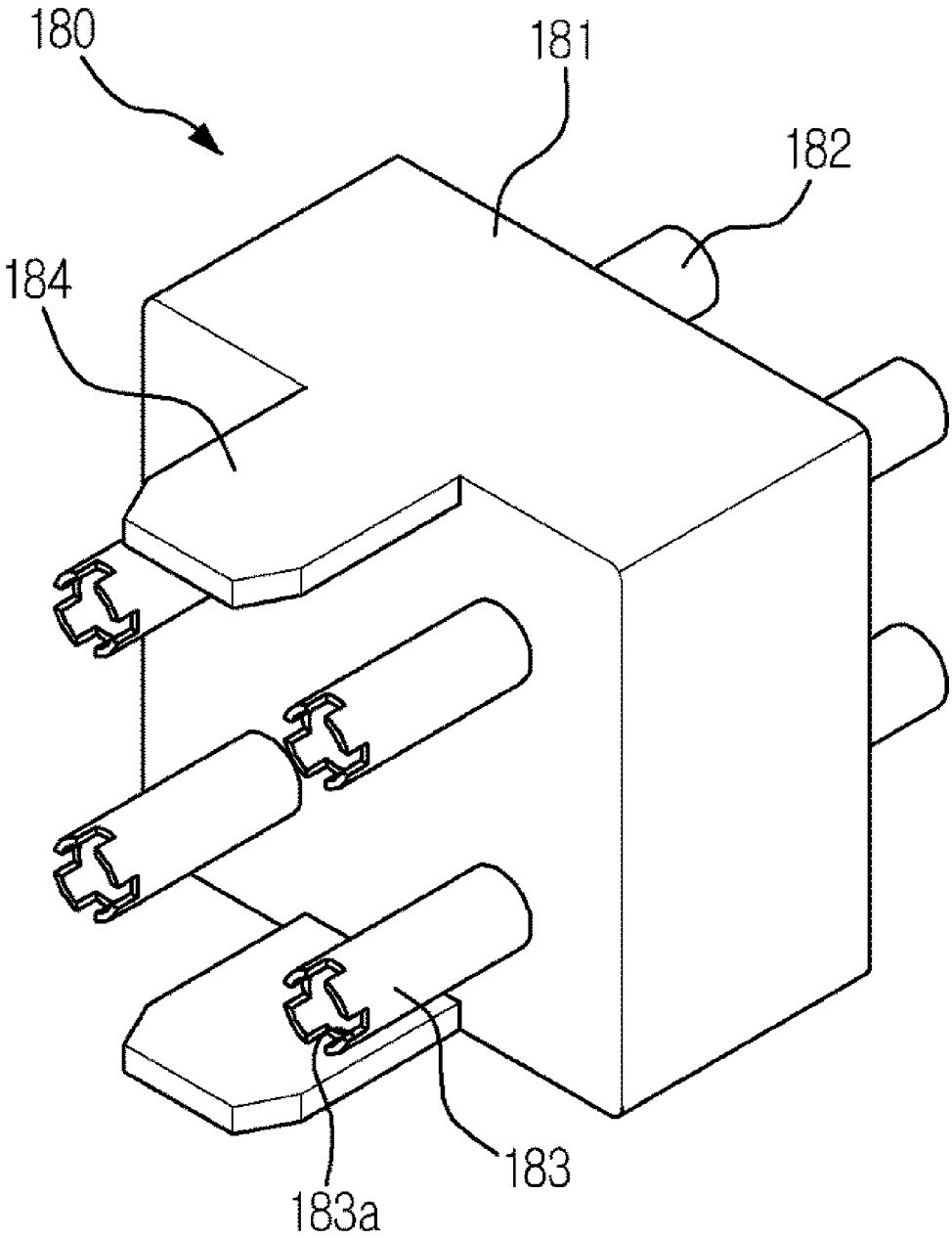
FIG. 12 is a perspective view schematically illustrating a first discharge connector of the image forming apparatus in accordance with the embodiment of FIG. 1.

As shown in FIG. 12, the first discharge connector 180 includes a fourth connector body 181 coupled into the cradle 110, a plurality of connecting tubes 182 protruding from one side surface of the fourth connector body 181 so as to be coupled with the plurality of ink discharge tubes 108, and a plurality of insertion tubes 183 protruding from the other side surface of the fourth connector body 181 to correspond to the plurality of connecting tubes 182. Each of the insertion tubes 183 has third inlet holes 183*a* formed at a distal end thereof, through which the ink of the third chamber 193 is introduced into the insertion tube 183 when the insertion tube 183 is inserted into the third chamber 193 by pushing the third valve member 195 of the second discharge connector 190.

A pair of guide bars 184 protrudes from the top and bottom of the other side surface of the fourth connector body 181, such that they are slidably movably inserted into the pair of guide grooves 191*b* of the third connector body 191. When the first discharge connector 180 and second discharge connector 190 are coupled with each other, the pair of guide bars 184 provided at the first discharge connector 180 slidably move along the pair of third guide grooves 191*b* provided at the second discharge connector 190, enabling stable coupling of the first discharge connector 180 and second discharge connector 190.

Hereinafter, a sequence to couple the print head 140 into the cradle 110 will be described with reference to the accompanying drawings.

To mount the print head 140 into the cradle 110, as shown in FIGS. 2 and 3, the cradle 110 is first moved to the opening position. If the print head 140 is pushed into the head mount 114 of the cradle 110 at the opening position of the cradle 110, the guide rails 143 of the print head 140 move along the guide grooves 117 of the cradle 110, and the print head 140 is linearly moved and inserted into the head mount 114.

Figure 13:
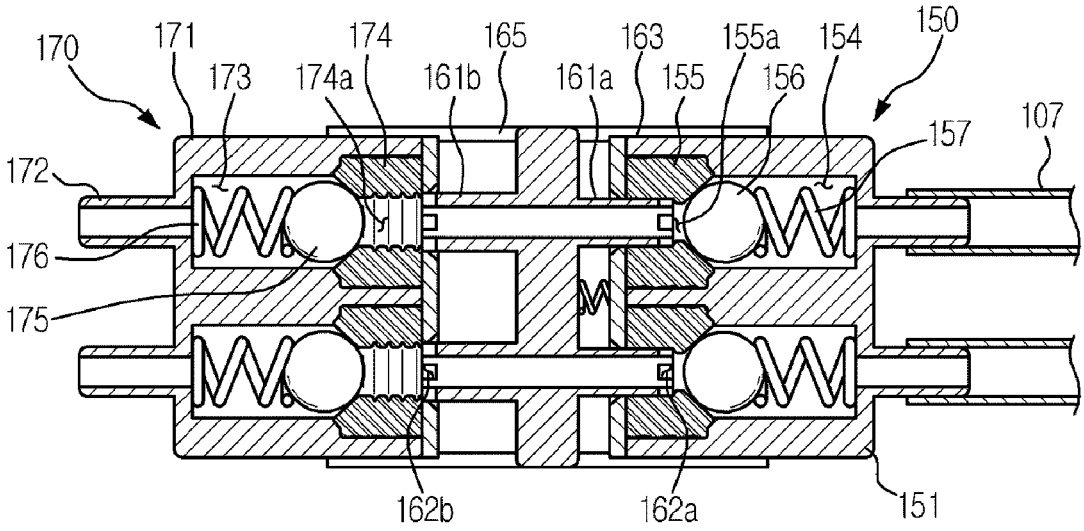
FIGS. 13 to 15 are side sectional views illustrating a sequence to couple the print head into the cradle of the image forming apparatus in accordance with the embodiment of FIG. 1.

As the print head 140 is pushed into the head mount 114, the second tubes 161*b* of the flow-path connecting device 160 come into contact, at their ends, with the second sealing members 174 of the second supply connector 170 through the second connecting holes 171*a*. Then, if the print head 140 is pushed further, as shown in FIG. 13, the flow-path connecting device 160 is pushed toward the first supply connector 150, and the first tubes 161*a* are inserted into the first orifices 155*a* of the first sealing members 155. In this case, since the hardness of the second sealing members 174 is higher than that of the first sealing members 155 and the outer diameter of the second tubes 161*b* is larger than that of the first tubes 161*a*, the second tubes 161*b* cannot be inserted into the second orifices 174*a* of the second sealing members 174 while the first tubes 161*a* are being inserted into the first orifices 155*a*.

Figure 14:
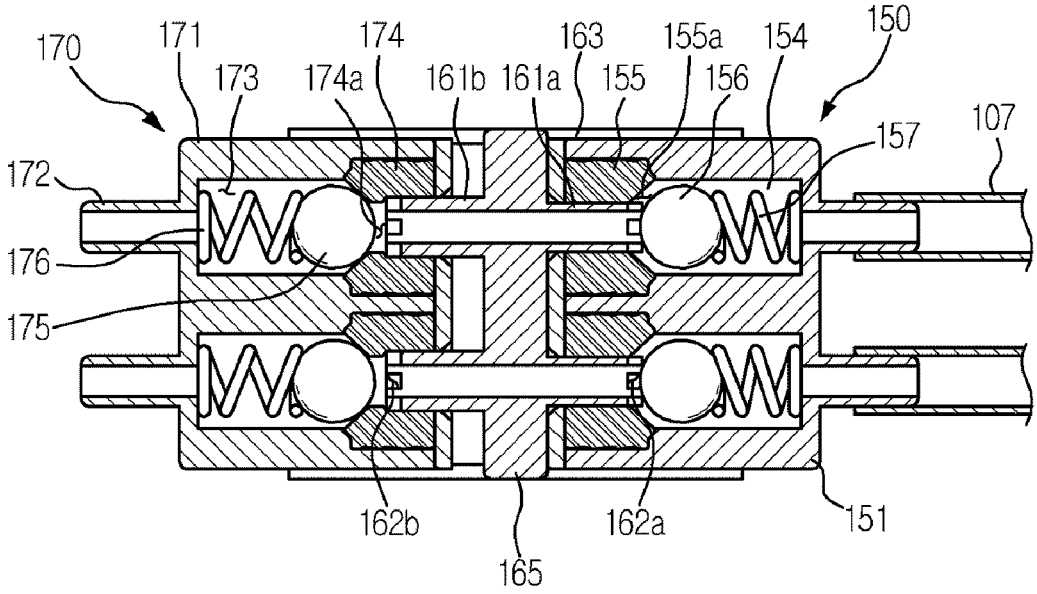

If the print head 140 is more deeply inserted into the head mount 114, as shown in FIG. 14, the first tubes 161*a* are inserted into the first chambers 154 through the first orifices 155*a* by pushing the first valve members 156. In this case, the ink in the first chambers 154 can be introduced into the first tubes 161*a* through the first inlet holes 162*a* formed at the end of the respective first tubes 161*a*. While the first tubes 161*a* are inserted into the first chambers 154, the second tubes 161*b* are inserted into the second orifices 174*a* of the second sealing members 174.

Figure 15:
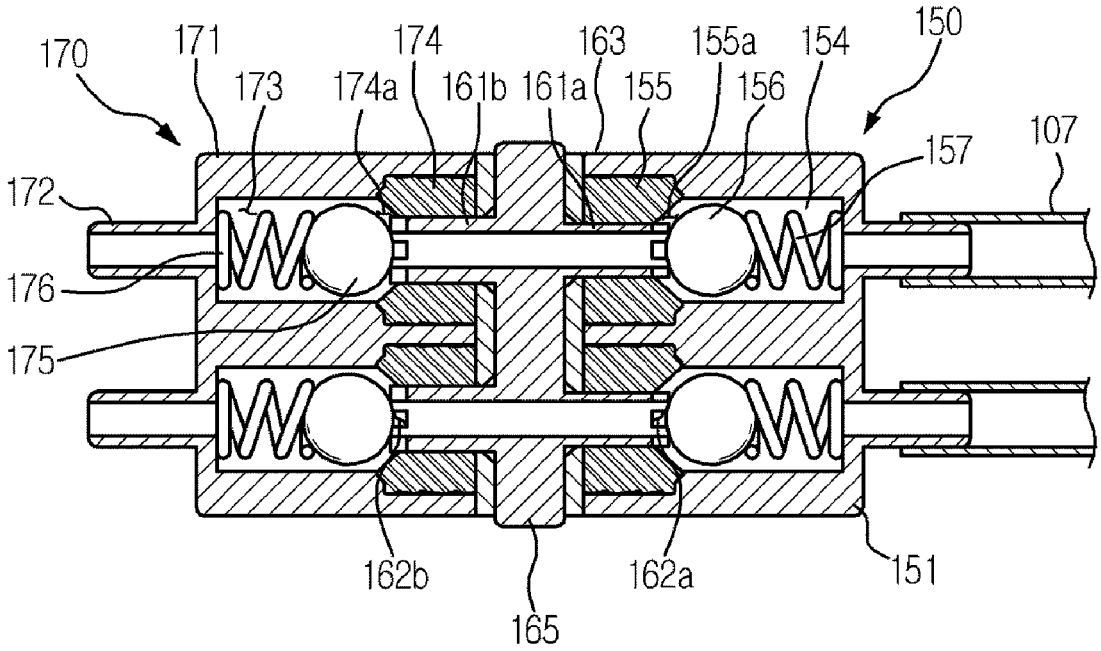

Finally, after the print head 140 is completely inserted into the head mount 114, as shown in FIG. 15, the second tubes 161*b* are inserted into the second chambers 173 through the second orifices 174*a* by pushing the second valve members 175. In this case, the first chambers 154 and the second chambers 173 are connected to each other via the flow-path connecting device 160. The ink introduced into the first tubes 161*a* move along the second tubes 161*b*, thereby being introduced into the second chambers 173 through the second inlet holes 162*b* formed at the end of the respective second tubes 161*b*. Accordingly, the ink in the ink tank 102 can be supplied into the print head 140.

During connection of the first supply connector 150 and second supply connector 170, the insertion tubes 183 of the first discharge connector 180 are inserted into the third chambers 193 through the third orifices 194*a* of the second discharge connector 190. Accordingly, the first discharge connector 180 and second discharge connector 190 can be connected to each other to enable movement of ink therethrough.

After the print head 140 is completely mounted in the cradle 110, the first power connector 131 and first signal connector 133, provided at the cradle 110, are coupled with the second power connector 135 and second signal connector 137 of the print head 140, respectively, to supply power and signals to the print head 140. Then, as the protruding portions 127 of the detaching levers 126 provided at the cradle 110 are inserted into the fixing recesses 144 of the print head 140, the print head 140 cannot be easily separated from the cradle 110.

As described above, in the image forming apparatus 100 described above, the second power connector 135 and second signal connector 137 of the print head 140 can be connected with the first power connector 131 and first signal connector 133 of the body 101 by simply inserting the print head 140 into the head mount 114 of the cradle 110. Accordingly, easy installation or separation of the print head 140 can be accomplished.

Also, in the image forming apparatus 100 described above, the cradle 110 can be moved upward from the body 101 by a predetermined distance. Accordingly, when moving the cradle 110 to the opening position, it is easy to insert or separate the print head 140 into or from the cradle 110. Further, even if a printing medium is jammed during a printing operation, it is possible to easily remove the jammed printing medium from the body 101 by moving the cradle 110 to the opening position so as to expose the top of the body 101 to the outside.

In the image forming apparatus 100 described above, the ink tank 102 and regulator 103 are installed in the body 101, and the print head 140 is detachably installed to the body 101 regardless of the ink tank 102 and regulator 103. With this configuration, it is possible to exchange only the print head 140 without disposal of the ink tank 102 and regulator 103. Accordingly, maintenance costs can be reduced.

Also, when the print head 140 is separated from the body 101, or is again installed into the body 101, the regulator 103 can be connected with the print head 140 while maintaining an initial negative pressure therein by virtue of interaction of the first supply connector 150 and second supply connector 170. Accordingly, the image forming apparatus 100 can substantially prevent outside air from entering the ink to be supplied into the print head 140, and can prevent leakage of ink caused upon release of the negative pressure inside the regulator 103.

In the image forming apparatus 100, the first power connector 131, second power connector 135, first signal connector 133 and second signal connector 137 are arranged perpendicular to the body 101 on the basis of a bottom surface of the body 101. With the arrangement of the connectors 131, 135, 133, and 137, the print head 140 having the second power connector 135 and second signal connector 137 can be configured to have a minimum compact size, and thus, can be manufactured with reduced material costs.

Figure 16:
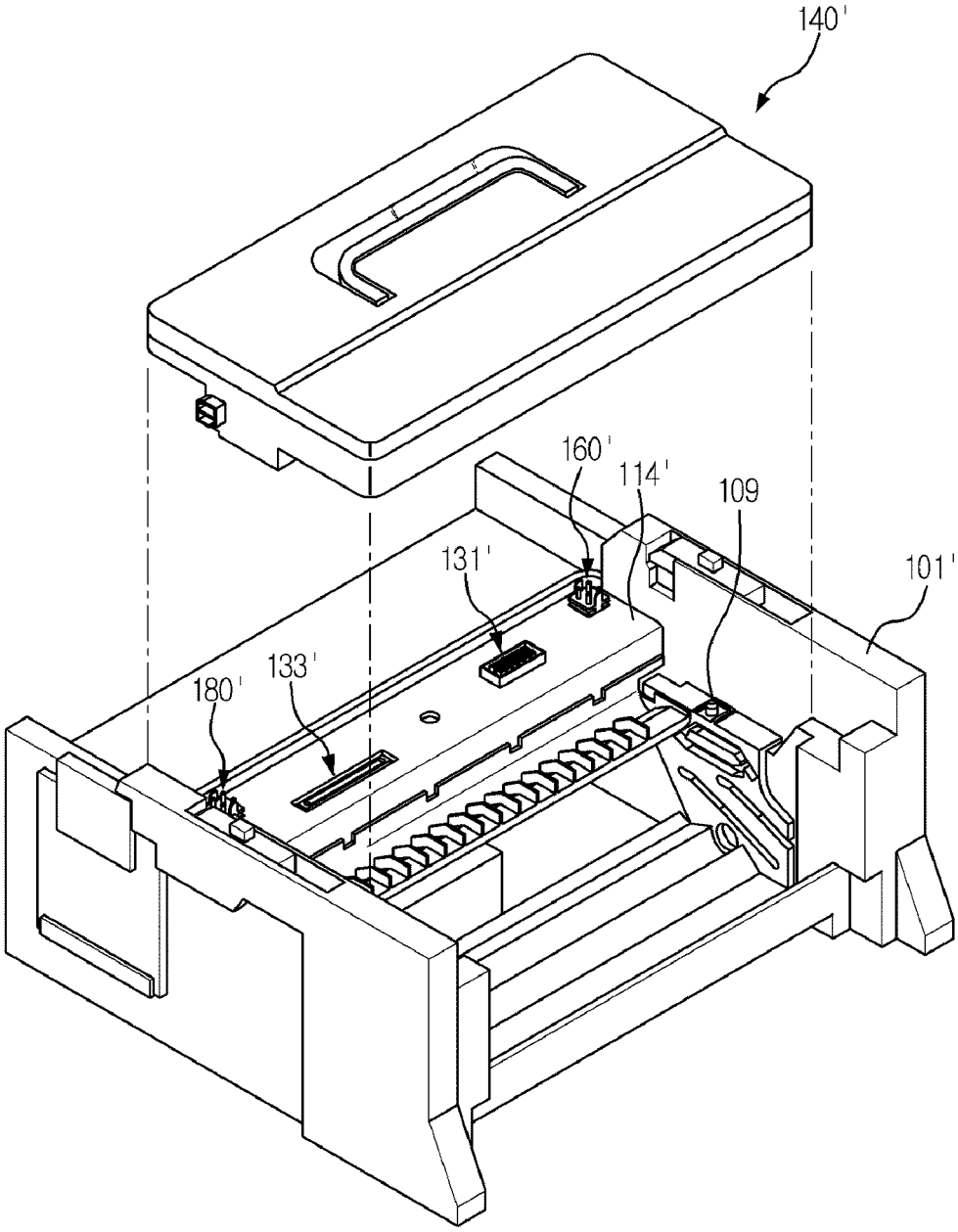
FIG. 16 is a perspective view schematically illustrating an image forming apparatus in accordance with another embodiment of the present general inventive concept.
Figure 17:
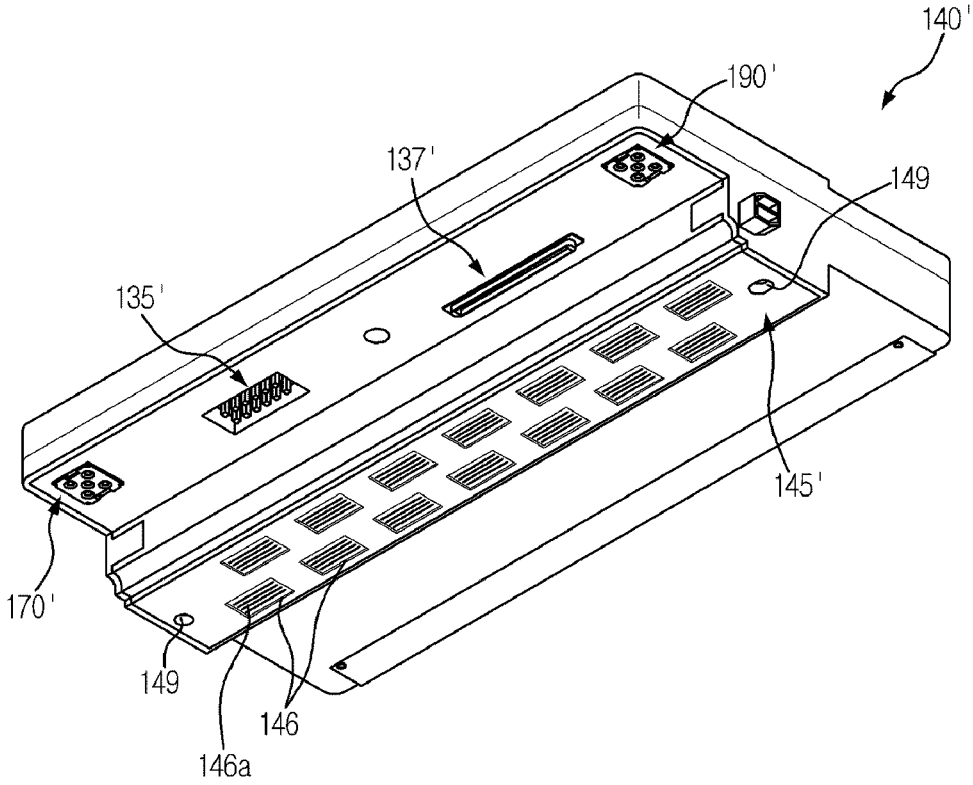
FIG. 17 is a perspective view schematically illustrating a print head of the image forming apparatus in accordance with the embodiment of FIG. 16.

In the present embodiment, although the print head 140 is mounted to the body 101 via the cradle 110 mounted in the body 101, the general inventive concept is not limited thereto. In another embodiment of the present general inventive concept as shown in FIGS. 16 and 17, a print head 140' may be directly mounted to an upper surface of a body 101' without any configuration corresponding to a cradle. Specifically, a head mount 114', which is provided with a plurality of first connectors 131', 133', 150' and 180', is provided at the upper surface of the body 101'. The print head 140' is provided at a lower surface thereof with a plurality of second connectors 135', 137', 170' and 190'. As the print head 140' is mounted to the body 101' via vertical movement thereof, the second connectors 135', 137', 170' and 190' provided at the print head 140' are connected, respectively, with the first connectors 131', 133', 150' and 180' provided at the head mount 114'.

The above-described image forming apparatus is provided with guides to assist the print head 140' to be accurately mounted at a desired position of the body 101'. In the present embodiment, the guides include guiding protrusions 109 protruding upward from the body 101' and guiding holes 149 formed at the lower surface of the print head 140' to allow insertion of the guiding protrusions 109. Accordingly, as the print head 140' is moved downward so as to be mounted to the upper surface of the body 101', the guiding protrusions 109 are inserted into the respective guiding holes 149 and a position of the print head 140' can be accurately adjusted. This assures accurate coupling between the first connectors 131', 133', 150' and 180' and the second connectors 135', 137', 170' and 190'. In the present embodiment, although the guiding protrusions 109 are formed at the body 101' and the guiding holes 149 are formed at the print head 140', a contrary configuration is also possible.

As apparent from the above description, in the image forming apparatus according to the exemplary embodiments of the present general inventive concept, a print head is mounted to a head mount such that a first power connector, first signal connector, first supply connector and first discharge connector provided at the head mount are connected, respectively, with a second power connector, second signal connector, second supply connector and second discharge connector provided at the print head, whereby efficient transmission of power and signals to the print head as well as efficient supply and discharge of ink can be assured, resulting in easy installation or separation of the print head.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An image forming apparatus comprising:

a body;

a print head including a nozzle part having a length greater than a width of a printable printing medium;

a head mount provided at the body to mount the print head;

at least one first connector provided at the head mount;

at least one second connector provided at the print head to correspond to the at least one first connector, a flow-path connecting device installed between the first connector and the second connector to transmit ink between the first connector and the second connector; and a return spring mounted between the first connector and the flow-path connecting device to bias the flow-path connecting device away from the first connector when the flow-path connecting device is detached from the first connector, wherein the first connector and second connector are connected with each other as the print head is mounted to the head mount, and the first connector includes at least a first supply connector connected with an ink supply tube to supply ink from the head mount to the print head, and a first discharge connector connected with an ink discharge tube to discharge ink from the print head to the head mount.

2. The apparatus according to claim 1, wherein the first connector further includes at least one of a first power connector to supply power to the print head, and a first signal connector to transmit signals to the print head.

3. The apparatus according to claim 2, wherein the second connector includes at least one of a second power connector connected with the first power connector to receive power, a second signal connector connected with the first signal connector to receive signals transmitted thereto, a second supply connector connected with the first supply connector to supply ink into the nozzle part from the head mount, and a second discharge connector connected with the first discharge connector to receive from the print head to the head mount.

4. The apparatus according to claim 3, wherein the second discharge connector includes a third connector body having a third chamber and a third sealing member installed in the third connector body and having a third orifice connected with the third chamber, and the first discharge connector includes an insertion tube to be inserted into the third orifice to thereby be connected with the third chamber.

5. The apparatus according to claim 4, wherein a third valve member to open or close the third orifice and a third valve spring to press the third valve member to cause the third valve member to come into contact with the third sealing member are installed in the third chamber.

6. The apparatus according to claim 2, wherein the first supply connector includes a first connector body having a first chamber and a first sealing member installed in the first connector body and having a first orifice connected with the first chamber, the second supply connector includes a second connector body having a second chamber and a second sealing member installed in the second connector body and having a second orifice connected with the second chamber, and a flow-path connecting device is installed between the first connector body and the second connector body and includes a flow-path tube having one end inserted into the first orifice to thereby be connected with the first chamber and the other end inserted into the second orifice to thereby be connected with the second chamber.

7. The apparatus according to claim 6, wherein a first valve member to open or close the first orifice and a first valve spring to press the first valve member to cause the first valve member to come into contact with the first sealing member are installed in the first chamber, and a second valve member to open or close the second orifice and a second valve spring to press the second valve member to cause the second valve member to come into contact with the second sealing member are installed in the second chamber.

8. The apparatus according to claim 1, further comprising:

a cradle provided with the head mount and pivotally rotatably mounted at the body.

9. The apparatus according to claim 1, wherein the head mount is provided at an upper surface of the body facing away from the body to allow the print head to be installed to or separated from the head mount via vertical movement thereof towards and away from the body, respectively.

10. The apparatus according to claim 9, further comprising:

a guide to guide installation/separation of the print head.

11. The apparatus according to claim 10, wherein the guide includes a guiding protrusion protruding from any one of the body and print head, and a guiding hole formed in the other one of the body and print head, into which the guiding protrusion is inserted.

12. An image forming apparatus comprising:

a body;

a print head including a nozzle part having a length greater than a width of a printable printing medium;

a cradle pivotally rotatably mounted at the body and provided with a head mount to detachably receive the print head;

at least one first connector provided at the head mount;

at least one second connector provided at the print head to correspond to the at least one first connector, a flow-path connecting device installed between the first connector and the second connector to transmit ink between the first connector and the second connector; and a return spring mounted between the first connector and the flow-path connecting device to bias the flow-path connecting device away from the first connector when the flow-path connecting device is detached from the first connector, wherein the first connector and second connector are connected with each other as the print head is mounted to the head mount, and the first connector includes a first discharge connector to withdraw the ink of the print head from the print head.

13. The apparatus according to claim 12, wherein the first connector includes at least one of a first power connector to supply power to the print head, a first signal connector to transmit signals to the print head, and a first supply connector to supply ink into the print head.

14. The apparatus according to claim 13, wherein the second connector includes at least one of a second power connector connected with the first power connector to receive power, a second signal connector connected with the first signal connector to receive signals from the body, a second supply connector connected with the first supply connector to receive ink supplied thereto, and a second discharge connector connected with the first discharge connector to receive the ink discharged from the print head.

15. The apparatus according to claim 12, further comprising:

a hinge shaft provided at the cradle to allow the cradle to be pivotally rotatably mounted at the body; and a supporting spring as a torsion spring installed to the hinge shaft to enable upward pivotal rotation of the cradle.

16. The apparatus according to claim 12, wherein guide grooves to guide mounting of the print head are provided at opposite sides of the head mount of the cradle, and the print head is provided with guide rails to be inserted into the guide grooves.

17. The apparatus according to claim 12, further comprising:

a detaching lever hingedly coupled to a side surface of the cradle and having a protruding portion formed at one end thereof and configured to be inserted into the head mount through an opening formed in the side surface of the cradle, wherein the print head has a fixing recess formed at a side surface thereof for insertion of the protruding portion.

18. The apparatus according to claim 17, further comprising:

a detaching spring installed at the side surface of the cradle and used to elastically support the other end of the detaching lever.

19. The apparatus according to claim 12, further comprising:

fixing protrusions protruding from opposite sides of the cradle;

insertion recesses provided at opposite sides of the body, into which the fixing protrusions are inserted as the cradle is pivotally rotated to a closing position; and slide levers slidably movably installed at opposite sides of the body and used to press the fixing protrusions inserted in the insertion recesses downward.

20. The apparatus according to claim 19, further comprising:

a stopper vertically movably installed in the corresponding slide lever and having a lower end to press an upper end of the fixing protrusion inserted in the insertion recess; and a stopper spring to elastically press the stopper downward.

21. An image forming apparatus comprising:

a body;

a print head including a nozzle part having a length at least greater than a width of a printable printing medium;

at least one first connector provided at an upper surface of the body;

at least one second connector provided at a lower surface of the print head to correspond to the at least one first connector, a flow-path connecting device installed between the first connector and the second connector to transmit ink between the first connector and the second connector; and a return spring mounted between the first connector and the flow-path connecting device to bias the flow-path connecting device away from the first connector when the flow-path connecting device is detached from the first connector, wherein the first connector and second connector are connected with each other as the print head is mounted to the body via vertical movement thereof, and the at least one first connector includes at least a first supply connector connected with an ink supply tube to supply ink from the body to the print head, and a first discharge connector connected with an ink discharge tube to discharge ink from the print head to the body.

22. The apparatus according to claim 21, further comprising:

a guide to guide installation/separation of the print head.

23. The apparatus according to claim 22, wherein the guide includes a guiding protrusion protruding from any one of the body and the print head, and a guiding hole formed in the other one of the body and the print head, into which the guiding protrusion is inserted.

24. An image forming apparatus comprising:

a body;

a print head including a nozzle part having a length greater than a width of a printable printing medium;

a cradle pivotally rotatably mounted at the body and provided with a heat mount to detachably receive the print head;

at least one first connector provided at the head mount;

at least one second connector provided at the print head to correspond to the at least one first connector; and a detaching lever hingedly coupled to a side surface of the cradle and having a protruding portion formed at one end thereof and configured to be inserted into the head mount through an opening formed in the side surface of the cradle, wherein the print head has a fixing recess formed at a side surface thereof for insertion of the protruding portion, and wherein the first connector and second connector are connected with each other as the print head is mounted to the head mount.

25. An image forming apparatus comprising:

a body;

a print head including a nozzle part having a length greater than a width of a printable printing medium;

a cradle pivotally rotatably mounted at the body and provided with a head mount to detachably receive the print head;

at least one first connector provided at the head mount;

at least one second connector provided at the print head to correspond to the at least one first connector;

fixing protrusions protruding from opposite sides of the cradle;

insertion recesses provided at opposite sides of the body, into which the fixing protrusions are inserted as the cradle is pivotally rotated to a closing position; and slide levers slidably movably installed at opposite sides of the body and used to press the fixing protrusions inserted in the insertion recesses downward, wherein the first connector and second connector are connected with each other as the print head is mounted to the head mount.

26. An image forming apparatus comprising:

a body;

a print head including a nozzle part having a length greater than a width of a printable printing medium;

a cradle pivotally rotatably mounted at the body and provided with a head mount to detachably receive the print head;

at least one first connector provided at the head mount;

at least one second connector provided at the print head to correspond to the at least one first connector;

a flow-path connecting device installed between the first connector and the second connector to transmit ink between the first connector and the second connector; and a return spring mounted between the first connector and the flow-path connecting device to bias the flow-path connecting device away from the first connector when the flow-path connecting device is detached from the first connector, wherein the first connector and second connector are connected with each other as the print head is mounted to the head mount, wherein a paper movement direction across the print head during a print operation defines a first direction, the at least one first connector faces the first direction during the print operation, and the at least one first connector is rotated to face a direction other than the first direction to mount the print head to the head mount and to disconnect the print head from the head mount.

27. An image forming apparatus comprising:

a body;

a print head including a nozzle part having a length at least greater than a width of a printable printing medium;

at least one first connector provided at an upper surface of the body to face away from the body;

at least one second connector provided at a lower surface of the print head to correspond to the at least one first connector;

a flow-path connecting device installed between the first connector and the second connector to transmit ink between the first connector and the second connector; and a return spring mounted between the first connector and the flow-path connecting device to bias the flow-path connecting device away from the first connector when the flow-path connecting device is detached from the first connector, wherein the first connector and second connector are connected with each other as the print head is mounted to the body via vertical movement thereof towards the body.

* * * * *